US008230840B2

(12) United States Patent
Agneray et al.

(10) Patent No.: US 8,230,840 B2
(45) Date of Patent: Jul. 31, 2012

(54) FLUID INJECTION DEVICE

(75) Inventors: Andre Agneray, Boulogne (FR); Nadim Malek, Versailles (FR); Laurent Levin, Paris (FR); Marc Pariente, Paris (FR)

(73) Assignee: Renault S.A.S., Boulogne Billancourt (FR)

( * ) Notice: Subject to any disclaimer, the term of this patent is extended or adjusted under 35 U.S.C. 154(b) by 191 days.

(21) Appl. No.: 12/666,671

(22) PCT Filed: Jun. 25, 2008

(86) PCT No.: PCT/FR2008/051146

§ 371 (c)(1),
(2), (4) Date: Apr. 8, 2010

(87) PCT Pub. No.: WO2009/007595

PCT Pub. Date: Jan. 15, 2009

(65) Prior Publication Data

US 2010/0307455 A1 Dec. 9, 2010

(30) Foreign Application Priority Data

Jun. 27, 2007 (FR) ..... 07 04635

(51) Int. Cl.
*F02M 37/08* (2006.01)
*F02M 37/04* (2006.01)

(52) U.S. Cl. ..... 123/498; 123/490

(58) Field of Classification Search ..... 123/498, 123/490, 494, 499; 239/102.2, 585.1; 251/129.18
See application file for complete search history.

(56) References Cited

U.S. PATENT DOCUMENTS

| | | | | |
|---|---|---|---|---|
| 3,194,162 | A * | 7/1965 | Williams | 417/322 |
| 3,418,980 | A * | 12/1968 | Benson | 123/294 |
| 5,169,067 | A | 12/1992 | Matsusaka et al. | |
| 5,199,641 | A | 4/1993 | Hohm et al. | |
| 7,309,027 | B2 * | 12/2007 | Magel et al. | 239/88 |

FOREIGN PATENT DOCUMENTS

| | | |
|---|---|---|
| DE | 198 54 508 | 5/2000 |
| EP | 0 361 480 | 4/1990 |
| FR | 2 832 189 | 5/2003 |
| GB | 2 327 982 | 2/1999 |

OTHER PUBLICATIONS

U.S. Appl. No. 13/119,259, filed Mar. 16, 2011, Agneray, et al.
U.S. Appl. No. 12/602,268, filed Nov. 30, 2009, Agneray, et al.

* cited by examiner

*Primary Examiner* — Mahmoud Gimie
(74) *Attorney, Agent, or Firm* — Oblon, Spivak, McClelland, Maier & Neustadt, L.L.P.

(57) ABSTRACT

The invention relates to an injector including a needle mounted in a nozzle and having an end defining a valve, the needle being connected at the other end to an actuator including first, second and third portions, the first and third portions being provided on either side of the second portion, the three portions being tightened together in order to form a block having two axially opposite limits, the first portion being connected with the needle at one of said limits, and an excitation means for vibrating the second portion according to setpoint period τ. According to the invention, the length between the two limits of the block is such that the propagation time T of the acoustic waves generated by the vibrations of the second portion of the actuator and running along that length meets the equation: T=n*[τ/2], where n is an integer positive multiplication coefficient different from zero.

20 Claims, 8 Drawing Sheets

131
151
13
130
10
9

1
11'
C
11'
2
23
L=f(T)
T=n*[τ/2]
22
221
14
D1-1
IAC-ZJ
21
IA-ZJ
ZJ
D
4
D4
LA=fA(TA)
TA=nA*[τ/2]
A
B
X
3
6
7
8
LB=fB(TB)
TB=nB*[τ/2]
5'
15

FLUID INJECTION DEVICE

BACKGROUND

The invention relates to a device for injecting a fluid, for example a fuel, in particular for an internal combustion engine.

More precisely, the invention relates, according to a first of its aspects, to a fluid injection device having a main injection axis and comprising:

- a nozzle comprising, on said axis, an injection orifice and a seat and being, at the opposite end, connected to a casing,
- a needle having, on said axis, a first end defining a valve element, in a zone of contact with the seat and being, at the opposite end, connected to an actuator mounted so as to be able to move axially in the casing in order to vibrate the needle, providing between its first end and the seat of the nozzle a relative movement capable of alternately opening and closing the valve element, the actuator comprising, on the axis, a first portion, a second portion and a third portion suitable for being traversed by acoustic waves initiated by vibrations of the second portion, the first portion and third portion being placed axially on either side of the second portion, which comprises an electroactive material, the three portions being squeezed together in order to form a block having axially two opposite limits, the first portion being connected to the needle at the location of one of said limits,
- excitation means for vibrating the second portion of the actuator with a setpoint period $\tau$.

Such an injection device, called an injector, makes it possible to obtain a cyclic opening with the setpoint period $\tau$, at a controlled frequency that is for example ultrasonic and at a controlled amplitude, of the valve element of the injector, in particular during an established speed of its operation, that is to say during operation at a predetermined temperature outside the starting and stopping phases of the injector. A layer formed by the fluid escaping from the nozzle at the opening of the valve element is broken up and forms fine droplets. In an application of the injector in which it sprays fuel into a combustion chamber, the fine droplets promote a more homogeneous air-fuel mixture, which makes the engine less polluting and more economical.

According to known devices, the cyclic opening of the valve element is carried out with the aid of conventional vibration means, for example piezoelectric and/or magnetostrictive means with corresponding excitation means. The vibration means are arranged in the actuator having axially two opposite limits, one of which, called the first limit, is connected to the needle. Excited by the vibration means, the actuator converts an electric energy into vibrations of its first limit, with the setpoint period $\tau$ and a predetermined amplitude. The actuator acting, via its first limit, directly on the needle therefore plays a role of an active "master" controlling the needle which is then a passive controlled "slave". Specifically, the vibrations of the first limit of the "master" actuator produce longitudinal alternating movements of the "slave" needle and therefore of its first end, relative to the seat of the nozzle. In order to provide a sufficient flow rate of fuel when the valve element opens, it is necessary for the head of the needle and the nozzle to be made to resonate substantially in phase opposition. For this, the characteristic lengths of the needle and that of the nozzle are chosen, in a known manner, so that the acoustic wave propagation times in respective materials forming the needle and the nozzle are equal to a quarter of the period of the vibrations $\tau/4$ or to odd multiples of said quarter of the period, that is to say equal to $[2j+1]*\tau/4$ with a positive, non-zero integer multiplying coefficient j. Resonating "needle/nozzle" and "needle/actuator" structures thus formed generate high amplitudes of opening of the valve element at low pressures, for example, equal to or less than 5 MPa, in the combustion chamber. Gradually, as the fuel is injected during a compression cycle the pressure in the combustion chamber and, consequently, a backpressure at the valve element increases. This backpressure may also vary according to the point of operation of the engine. With the increase in the backpressure, the intensity of the impacts of the first end of the needle on its seat, even damped by the layer of fuel, becomes ever greater. The feedback of these impacts, on the one hand, in the resonating "needle/nozzle" structure as a conventional quarter wavelength $[2n+1]*\tau/4$ and, on the other hand, in the other resonating "needle/actuator" structure induces a coupling between the impact and a lifting of the first end of the needle from its seat by modifying the amplitude of opening of the valve element. If the impacts persist, the lifting of the head becomes chaotic. The benefit of the resonances is lost. The opening of the valve element becomes chaotic thus reflecting a disordered operation of the injector which may render the flow rate of fuel difficult to control.

BRIEF SUMMARY

In this context, the object of the present invention is to propose a fluid injection device designed at least to reduce at least one of the above-mentioned limitations. For this purpose, the injection device, moreover according to the generic definition given of it in the above preamble, is essentially characterized in that the length between the two limits of the block is such that the time T for propagating the acoustic waves initiated by the vibrations of the second portion of the actuator and traveling along this length satisfies the following equation: $T=n*[\tau/2]$, give or take a tolerance and where n is a multiplying coefficient, a non-zero positive integer.

Such an arrangement of the injector must make it possible to tend toward the following results: the resonating "needle/actuator" structure comprises at least one element—the actuator forming said block—which has a "symmetry" in acoustic terms. This means that an echo of an acoustic wave transmitted in a location of the symmetric block returns, after one or more reflections at the limits of the block, to this same transmission location of the acoustic wave a non-zero positive integer number of periods after it has been transmitted. For example, any acoustic wave traveling up the needle of the valve element toward the actuator and entering the latter via the limit, called the first limit of the block, between the needle and the first portion of the actuator is propagated axially in the actuator in order subsequently to be reflected on the limit, called the second limit of the block, opposite to said first limit. Thanks to the symmetrical resonating structure of the actuator, a first reflected wave, that is to say a first echo of the wave transmitted at the first limit, returns to this same first limit one period later after it is transmitted. The same applies to the acoustic waves, initiated by the electroactive material of the second portion of the actuator and being propagated axially toward the needle, which can, in their turn, be reflected on the first limit, return to the actuator to be reflected to the second limit, then return to the first limit one period later after their departure from the first limit. The symmetrical resonating structure of the actuator does not therefore generate any delay or change of sign of the waves—in particular for that of the sine wave where a portion of the sine wave in positive follows a symmetrical portion of the sine wave in negative—transmitted to the first limit irrespective of the origin of these waves (from the needle or from the actuator). The symmetrical resonating structure of the actuator therefore contributes to an ordered operation of the injector.

According to a second of its aspects, the invention relates to an internal combustion engine using the fluid injection device according to the invention, that is to say such an engine in which this injection device is placed.

BRIEF DESCRIPTION OF THE DRAWINGS

Other features and advantages of the invention will clearly emerge from the description given thereof below, as an indication and in no way limiting, with reference to the appended drawings in which.

DETAILED DESCRIPTION

Figure 1:
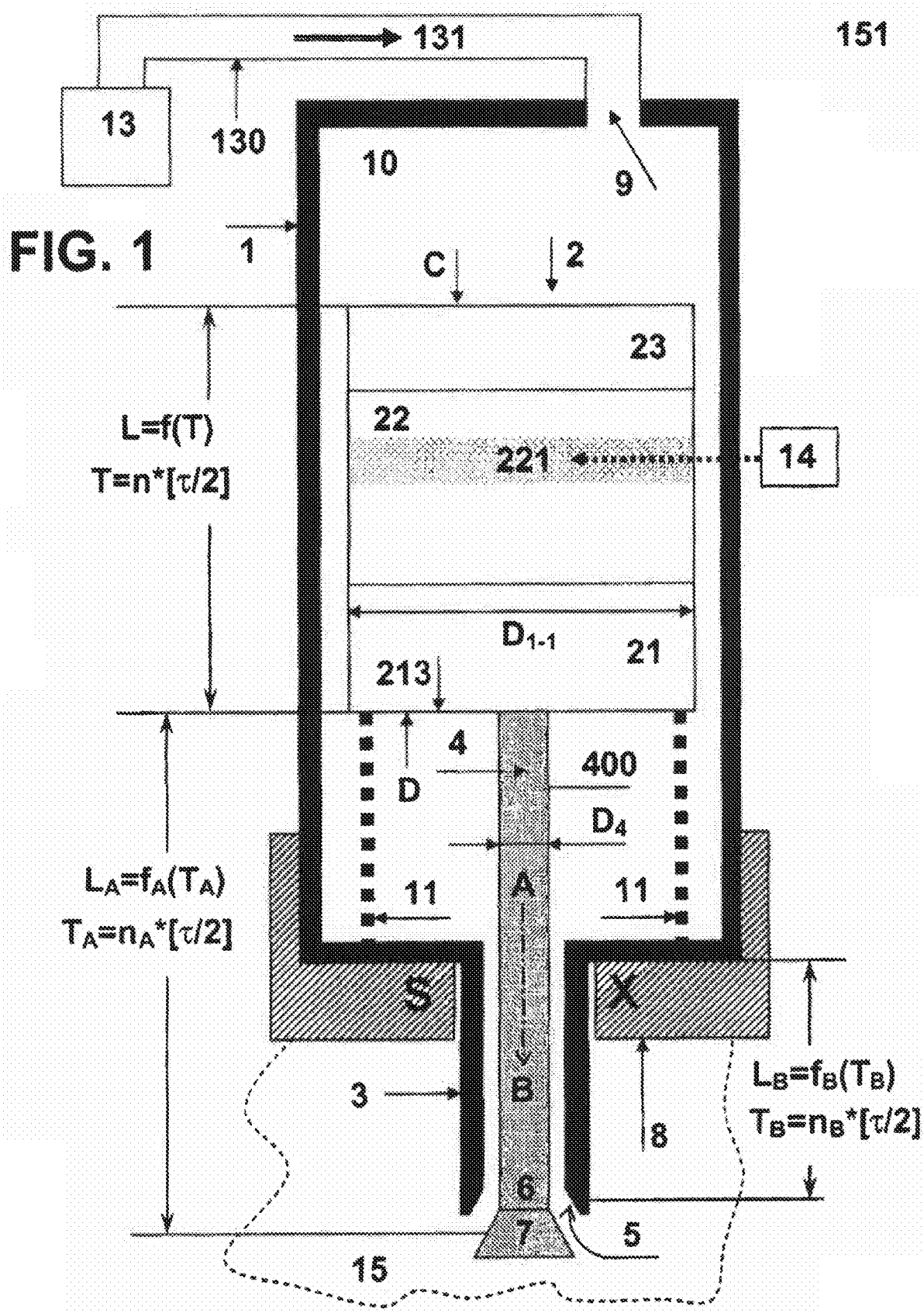
FIG. 1 is a diagram of an injection device according to the invention arranged in an engine and fitted with a needle with an outward-facing head connected to an actuator.

The injection device, or injector, of FIG. 1 (or 2) is designed to inject a fluid, for example, a fuel 131 into a combustion chamber 15 of an internal combustion engine 151, or into an air intake duct, not shown, or into an exhaust gas duct, not shown.

The injector comprises two bodies which are for example cylindrical. A first body representing a casing 1 is extended, on a preferred axis AB of the injection device, for example, its axis of symmetry, by at least one nozzle 3 having a length on the axis AB and comprising an injection orifice and a seat 5 (or 5'). The linear dimensions of the casing 1, for example, its width measured perpendicularly to the axis AB and/or its length measured along the axis AB, may be greater than those of the nozzle 3. The density of the casing 1 may be greater than that of the nozzle 3. The casing 1 may be connected to at least one circuit 130 of fuel 131 via at least one opening 9. The circuit 130 of fuel 131 comprises a device 13 for treating the fuel 131 comprising, for example, a tank, a pump and a filter.

Figure 2:
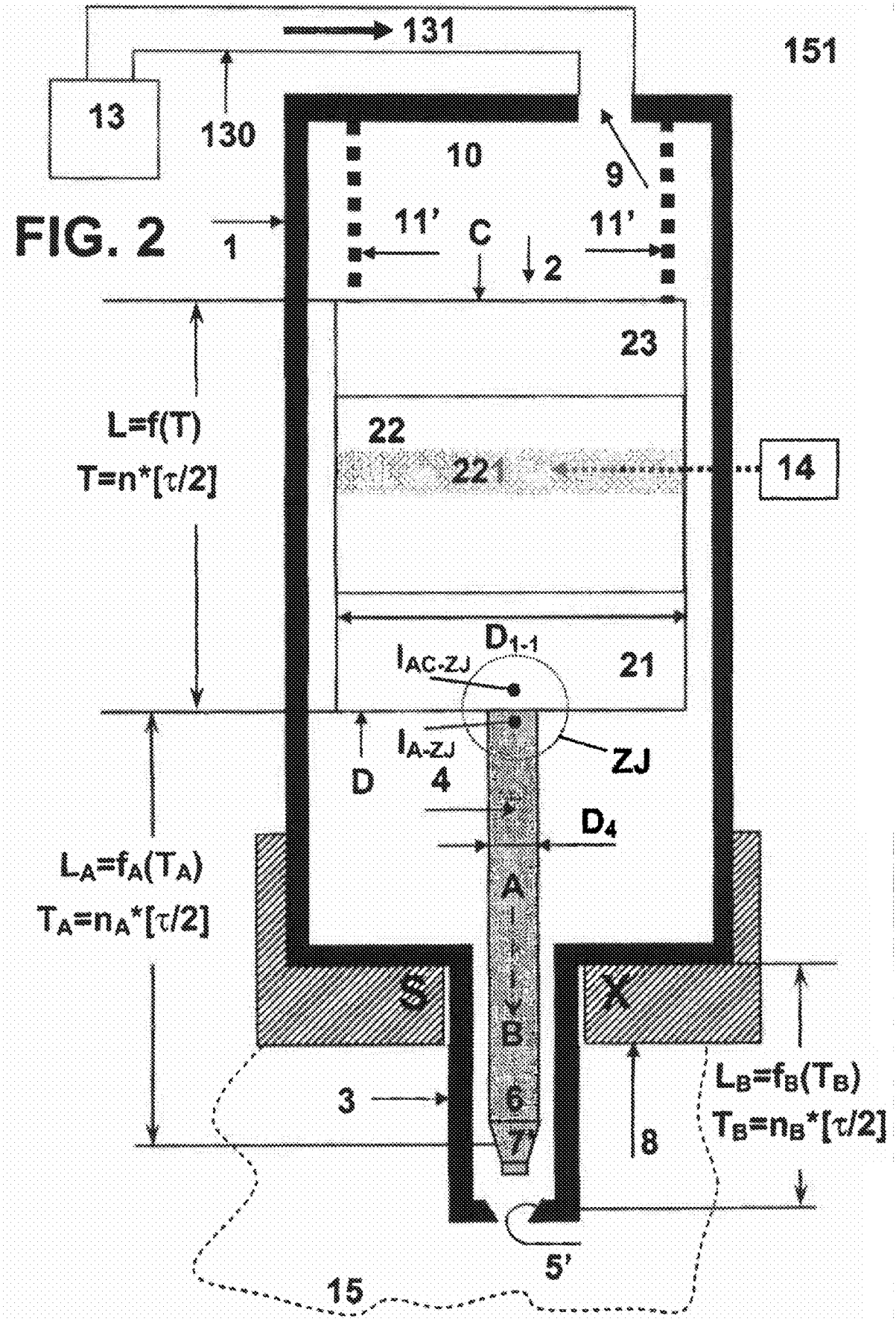
FIG. 2 is a diagram of an injection device according to the invention arranged in the engine and fitted with a needle with an inward-facing head connected to the actuator.
Figure 3:
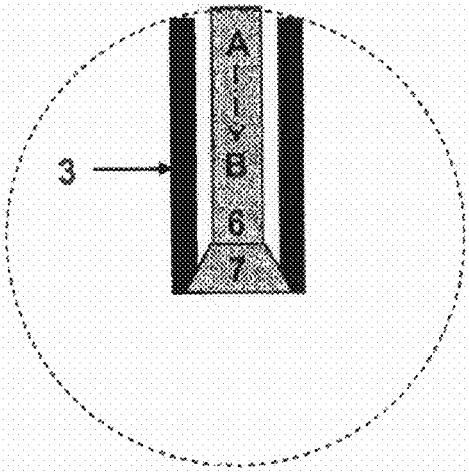
FIGS. 3 and 4 show diagrams illustrating an operation of the valve element formed by a nozzle and a needle with an outward-facing head: valve element closed (FIG. 3); valve element open (FIG. 4)
Figure 5:
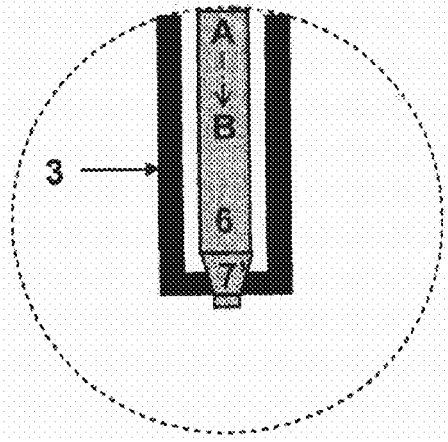
FIGS. 5 and 6 represent diagrams illustrating an operation of the valve element formed by a nozzle and a needle with an inward-facing head: valve element closed (FIG. 5); valve element open (FIG. 6)
Figure 4:
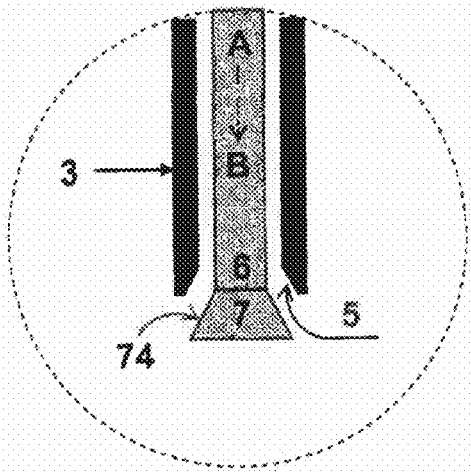
Figure 6:
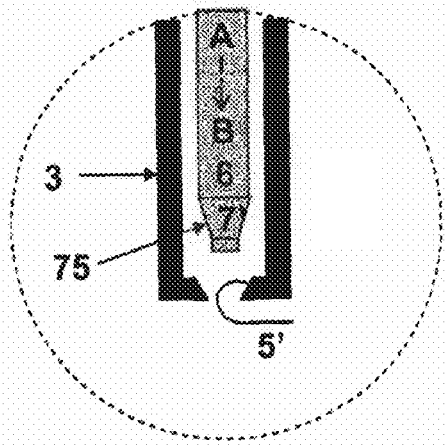
Figure 7:
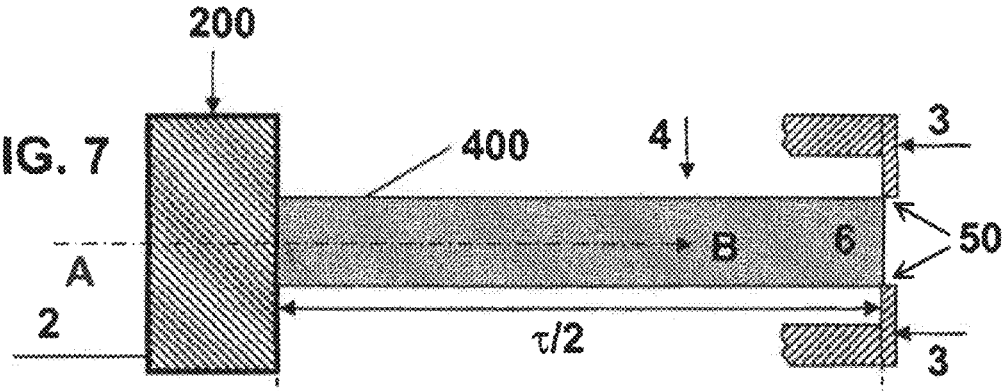
FIGS. 7 and 8 represent respectively in a schematic manner in a simplified side view in partial longitudinal section: a one-piece needle in the shape of a cylindrical bar (FIG. 7); a composite needle comprising three segments (FIG. 8)

A second body representing an actuator 2 is mounted so as to be able to move axially in the casing 1. A needle has, on the axis AB, a length and a first end 6 defining a valve element, in a zone of contact with the seat 5 (or 5') of the nozzle 3. The linear dimensions of the actuator 2, for example, its width measured perpendicularly to the axis AB and/or its length measured along the axis AB, may be greater than those of the needle 4. The density of the actuator 2 may be greater than that of the needle 4. The needle 4 and the actuator 2 are connected together by a zone of junction ZJ (FIG. 2). The first end 6 is preferably extended longitudinally, on the axis AB, opposite to the actuator 2, by a head 7 (or 7') closing off the seat 5 (or 5'), so as to ensure a better seal of the valve element of the injector.

FIG. 1 illustrates the situation of the needle 4 with the head 7 called outward-facing. The needle 4 with outward-facing head 7 has a flared shape diverging in a direction of the axis AB of the injector oriented from the casing 1 to the outside of the nozzle 3 in the combustion chamber 15. Preferably, the needle 4 with outward-facing head 7 has a frustoconical divergent flared shape (FIG. 1). The outward-facing head 7 closes off the seat 5 of the outside of the nozzle 3 oriented away from the casing 1, in the direction of the axis AB of the injector.

FIG. 2 illustrates the situation of the needle 4 with the head 7' called inward-facing. The needle 4 with inward-facing head 7' narrows in the direction of the axis AB oriented from the casing 1 to the outside of the nozzle 3 and closes off the seat 5' of the inside of the nozzle 3 oriented toward the casing 1.

Return means 11 (or 11') of the actuator 2 may be provided to keep the head 7 (or 7') of the needle 4 pressing against the seat 5 (or 5') of the nozzle 3. Therefore, the return means 11 (or 11') close the valve element whatever the pressure in the combustion chamber 15. The location of the point of application of the return forces on the actuator 2 is of no consequence. The return means 11 (or 11') may be represented by a prestressed coil spring placed on the axis AB downstream of the casing 1 (in particular in the case of the needle 4 with the outward-facing head 7, FIG. 1), or upstream of the casing 1 (in particular in the case of the needle 4 with the inward-facing head 7', FIG. 2) relative to the direction of flow of the fuel 131 toward the nozzle 3. The return means 11 (or 11') may also be formed by a fluidic means, for example of the hydraulic cylinder type, with the fuel 131 as the working liquid. The clearances due to the expansions of the various elements of the casing 1 are thus advantageously taken up by the return means 11 (or 11') so that the flow rate of the fuel 131 through the nozzle 3 tends to remain insensitive to the heat variations during the various operating speeds of the engine 151.

In the example of FIG. 1, the return means 11 are capable of deforming, for example, elastically, while exerting a predetermined force for a very slight lengthening, for example, of less than 100 μm, in order to pull the outward-facing head 7 of the needle 4 against the seat 5 of the nozzle 3 on the axis AB in order to close the valve element irrespective of the pressure in the combustion chamber 15.

In the example in FIG. 2, the return means 11' are capable of deforming, for example, elastically, while exerting a predetermined force for a very slight lengthening, for example, of less than 100 μm, in order to push the head 7' of the needle 4 against the seat 5' of the nozzle 3 on the axis AB in order to close the valve element irrespective of the pressure in the combustion chamber 15.

The actuator 2 is extended, on the axis AB, by the needle 4. As the "master", the actuator 2 is arranged for vibrating the "slave" needle 4 directly, with a setpoint period $\tau$, thereby ensuring between the first end 6 of the needle 4 and the seat 5 (or 5') of the nozzle 3 a relative axial movement suitable for alternately opening and closing the valve element, as illustrated in FIGS. 3-4 and 5-6. The vibrations occur at a predetermined frequency $\nu$, for example, an ultrasonic frequency that may vary from approximately $\nu$=20 kHz to approximately $\nu$=60 kHz, that is to say with the setpoint period $\tau$ of vibrations that is respectively between 50 microseconds and 16 microseconds. As an example, for a steel, a wavelength $\lambda$ of vibrations is approximately $10^{-1}$ m at $\nu$=50 kHz ($\tau$=20 microseconds).

It should be noted that, the inward-facing head 7' being narrowed (FIG. 2), its surface is less exposed, compared with that of the outward-facing head 7 (FIG. 1), to the backpressure waves in the combustion chamber 15. Similarly, the inward-facing head 7' has a lighter weight compared with that of the outward-facing head 7, which minimizes the amplitude of the stresses on the seat 5' (compared with that of the outward-facing head 7) at the time of an impact accompanying a closure of the valve element. Assembling the injector is easier because the needle 4 with inward-facing head 7' can first of all be mounted on the actuator 2 and then be inserted into the casing 1. The needle 4 with the inward-facing head 7' tends to be placed on the seat 5' under the effect of gravity. The injector therefore operates in a fail-safe manner provided there is an appropriate design. In the event of a defect in the return means 11' of the actuator 2, and even in their absence, the valve element remains in the closed position thereby ensuring that the injector with the inward-facing head 7' is sealed. Moreover, an accidental breakage of the needle 4 means that its broken portion remains in the casing 1 with no risk of falling into the combustion chamber 15.

The actuator 2 comprising, on the axis AB, a first portion 21, a second portion 22 and a third portion 23 suitable for being traversed by acoustic waves initiated by vibrations of the second portion 22, the first portion 21 and third portion 23 being placed axially on either side of the second portion 22 (FIGS. 1-2). The latter comprises an electroactive material 221. The three portions 21, 22, 23 are squeezed together in order to form a block having axially two opposite limits C, D, the first portion 21 being connected to the needle 4 at the location of one D of said limits C, D.

Preferably, the third portion 23 acts as a rear weight playing a role of even distribution of the stresses on the electroactive material 221.

Preferably, the electroactive material 221 is piezoelectric which may take the form, for example, of one or more ceramic piezoelectric shims stacked axially on one another in order to form the second portion 22 of the block. The selective deformations of the electroactive material 221, for example, the periodic deformations with the setpoint period $\tau$, generating the acoustic waves in the injector finally culminate in the relative movement of the head 7 (or 7') relative to the seat 5 (or 5') or viceversa, suitable for alternately opening and closing the valve element as specified hereinabove with reference to FIGS. 3-4 and 5-6. These selective deformations are controlled by the corresponding excitation means 14, for example, with the aid of an electric field created by a potential difference applied to electrodes secured to the piezoelectric electroactive material 221. Alternatively, the electroactive material 221 may be magnetostrictive. The selective deformations of the latter are controlled by corresponding excitation means, not shown, for example, with the aid of a magnetic induction resulting from a selective magnetic field obtained with the aid, for example, of an exciter, not represented, and, in particular, by a coil secured to the actuator 2 or by another coil surrounding the actuator 2.

The result of the above developments is that the nozzle 3 with the casing 1 and the needle 4 with the actuator form respectively a first and a second media for propagating of acoustic waves. Each of these two media has at least one linear acoustic impedance I which depends on a surface $\Sigma$ with a cross section of the medium perpendicular to the axis AB, on a density $\rho$ of the medium and on a velocity c of the sound in the medium: $I=f_I(\Sigma, \rho, c)$. To illustrate this ratio, let us examine various simplified examples in FIGS. 7-8 and 9-10 relating respectively to the needle 4 or the nozzle 3. For the purposes of simplification, it is understood that, for all these examples, the actuator 2 and the second body are indistinguishable. In order to obtain an opening of the valve element of the injector that is not very sensitive to the pressure in the combustion chamber 15, the injector controls in movement the first end 6 of the needle 4, while the seat (represented in a simplified manner in FIGS. 7-10 and bearing reference 50) of the nozzle 3 is held dynamically immobile or fixed while thus behaving like a movement node.

The needle 4 and the nozzle 3 are each shown as a body, the radial dimensions of which perpendicular to the axis AB are small relative to its length along the axis AB. In a solid bar 400 cited here as a simplified model of the needle 4 (FIG. 7) or in a longitudinally pierced bar 300 cited here as a simplified model of the nozzle 3 (FIG. 9), the propagation of the acoustic waves links the propagation of a jump in tension (force) $\Delta F_0$ and of a jump in speed $\Delta v$ with the aid of an equation: $\Delta F_0=\Sigma*\Delta\sigma=\Sigma*z*\Delta v$, where $\Sigma$ is a surface of a cross section of the bar perpendicular to its preferred axis AB, for example, its axis of symmetry, $\Delta\sigma=z*\Delta v$ is a jump in stress, z is an acoustic impedance defined by an equation: $z=\rho*c$ where $\rho$ is a density of the bar and c is a velocity of the sound in the bar. It is understood that the tension $F_0$ is positive for a compression and the speed v is positive in the direction of propagation of the acoustic waves. The product $I=\Sigma*z=\Sigma*\rho*c$ representative of the acoustic properties of the bar—solid or hollow—is called "acoustic linear impedance" or "linear impedance".

Figure 9:
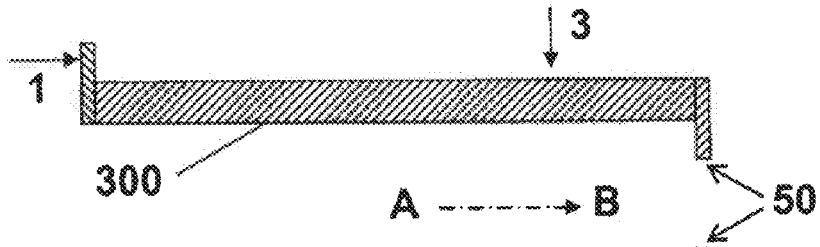
FIGS. 9 and 10 represent respectively schematically in a simplified side view in partial longitudinal section: a cylindrical one-piece nozzle (FIG. 9); a composite nozzle comprising three segments (FIG. 10)

Any variation of linear acoustic impedance I induces an echo, that is to say a weakening of the acoustic wave being propagated in a direction of the bar (for example from right to left in FIGS. 7, 9) by another acoustic wave being propagated in the reverse direction of the bar (for example from left to right in FIGS. 7, 9) from a point of variation of linear impedance I, for example at a junction between the needle 4 and the actuator 2 (FIG. 7) or at another junction between the nozzle 3 and the casing 1 (FIG. 9). This same reasoning can be applied to any linear impedance breakage I, the term "breakage" having to be understood as "a linear impedance variation I exceeding a predetermined threshold representative of a difference between the linear impedance upstream and that downstream, relative to the direction of propagation of the acoustic waves, of a zone of linear impedance breakage situated in a medium of propagation of the acoustic waves over a short distance compared to the wavelength, preferably, less than an eighth of the wavelength $\lambda/8$".

The injector may comprise at least one zone of linear acoustic impedance breakage existing at a distance from the zone of contact of the seat 50 with the first end 6 of the needle 4 along the nozzle 3 (FIG. 9) or the casing 1, and at least one other zone of linear acoustic impedance breakage existing at a distance from the zone of contact of the first end 6 with the seat 50 along the needle 4 (FIG. 7) or the actuator 2. Said zone and other zone of linear acoustic impedance breakage each being first in the order from said zone of contact between the first end 6 of the needle 4 and the seat 50, in a direction of propagation of the acoustic waves that is oriented respectively toward the casing 1 and the actuator 2.

As illustrated schematically in FIG. 1 (or 2), the distance, called the first distance $L_B$, between on the one hand the zone of contact between the seat 5 (or 5') and the first end 6, and on the other hand the first zone of linear acoustic impedance breakage along the nozzle 3 or the casing 1, is such that the time for propagation, called the "acoustic time-of-flight" $T_B$, of the acoustic waves initiated by the actuator 2 and traveling along this first distance $L_B=f_B(T_B)$ satisfies the following equation:

$$T_B=n_B*[\tau/2], \quad \text{(E1)}$$

where $n_B$ is a multiplying coefficient, a non-zero positive integer, called the first multiplying coefficient and the distance, called the second distance $L_A$, between on the one hand the zone of contact between the first end 6 and the seat 5 (or 5'), and on the other hand the first zone of linear acoustic impedance breakage along the needle 4 or the actuator 2, is such that the time for propagation, called the "acoustic time-of-flight" $T_A$, of the acoustic waves initiated by the actuator 2 and traveling along this second distance $L_A=f_A(T_A)$ satisfies the following equation:

$$T_A=n_A*[\tau/2], \quad \text{(E2)}$$

where $n_A$ is another multiplying coefficient, a non-zero positive integer, called the second multiplying coefficient, for example $n_A \neq n_B$.

It should be understood that the equations referenced E1 and E2 above must be considered as verified to within a certain tolerance in order to take account of manufacturing constraints, for example, to a tolerance of the order of plus or minus 10% of the setpoint period $\tau$, that is to say of the order of plus or minus 20% of the half-setpoint period $\tau/2$. Taking account of this tolerance, the equations referenced E1 and E2 above can be respectively rewritten as follows:

$$T_B=n_B*[\tau/2]\pm 0.2*[\tau/2] \quad \text{(E1')}$$

$$T_A=n_A*[\tau/2]\pm 0.2*[\tau/2] \quad \text{(E2')}$$

It should be noted that, in practice, the first distance $L_B=f_B(T_B)$ expressed as acoustic time-of-flight $T_B$ and the second distance $L_A=f_A(T_A)$ expressed as acoustic time-of-flight $T_A$, measured on corresponding parts manufactured on an industrial scale, may have slight variations relative to the reference values calculated with the aid of the equations E1 and E2 above. These slight variations may be due to an effect of attached weights. The latter may correspond, for example, to the head 7 (or 7') of the needle 4 and/or to a guide boss (not shown) in a plane perpendicular to the axis AB of the end 6 of the needle 4 in the nozzle 3. Said tolerance makes it possible to take account of said effect of attached weights so as to correct the expressions in acoustic time-of-flight of the first distance $L_B=f_B(T_B)$ and the second distance $L_A=f_A(T_A)$ with the aid of the equations E1' and E2' above.

Preferably, $n_A=n_B$ for the second and the first multiplying coefficients where, in particular, $n_A=n_B=1$ in order to minimize the linear dimensions of the injector on the axis AB in order to leave as much space as possible for the inlet and/or exhaust ducts. Therefore, beginning from the zone of contact between the seat 5 (or 5') and the first end 6 of the needle 4, the nozzle 3 has constant acoustic properties over successions of length representative of the first distance $L_B=f_B(T_B)$ that are substantially equal to one another in acoustic time-of-flight and of which the expression in acoustic time-of-flight $T_B$ preferably amounts to a single half-setpoint period $\tau/2$. Similarly, beginning from the zone of contact between the seat 5 (or 5') and the first end 6 of the needle 4, the latter has constant acoustic properties over successions of length representative of the second distance $L_A=f_A(T_A)$ that are substantially equal to one another in acoustic time-of-flight and of which the expression in acoustic time-of-flight $T_A$ preferably amounts to a single half-setpoint period $\tau/2$.

To make it easier to assemble, over at least 90% of the first distance $L_B=f_B(T_B)$, the injector may have a variation in linear acoustic impedance that is less than or equal to 5% without this variation being able to be considered a linear acoustic impedance breakage. Similarly, over at least 90% of the second distance $L_A=f_A(T_A)$, the injector may have another variation in linear acoustic impedance that is less than or equal to 5% without this variation being able to be considered a linear acoustic impedance breakage.

During an established speed of its operation, that is to say during operation at a predetermined temperature excluding starting and stopping phases of the injector, the latter advantageously makes it possible to alternately open and close the valve element in a manner that is not very sensitive to the pressure in the combustion chamber 15. In the example illustrated in FIG. 1, it involves both controlling the movement of the first end 6 extended by the head 7 of the needle 4 and keeping the seat 5 of the nozzle 3 dynamically immobile. As mentioned above, the movement control of the head 7 of the needle 4 takes place by virtue of the selective deformations, for example, periodic deformations with the setpoint period $\tau$, of the electroactive material 221 transmitted to the needle 4 by means of the actuator 2. The seat 5 is kept dynamically immobile by virtue of keeping its longitudinal speed on the axis AB equal to zero, taking advantage of the periodicity of the phenomenon of acoustic wave propagation. Each closure of the valve element during the periodic landings with the setpoint period $\tau$ of the head 7 of the needle 4 on the seat 5 produces an impact. The latter generates an acoustic wave, called an incident wave, associating a jump in speed $\Delta v$ and a jump in stress $\Delta\sigma$. This wave is propagated in the nozzle 3 toward the casing 1 while traveling over the first distance $L_B$, and is then reflected in the first zone of linear acoustic impedance breakage which is indistinguishable, in FIG. 1, from a location of recessing SX of the nozzle 3 in the casing 1 with a cross section, in a plane perpendicular to the axis AB, that is much larger than that of the nozzle 3. Once the incident wave has been reflected, its echo, called the reflected wave, returns to the nozzle 3 in order to travel the first distance $L_B$ in the reverse direction, that is to say from the casing 1 to the seat 5. The reflected wave has the same sign of the jump in stress $\Delta\sigma$ as the incident wave and the inverse sign of the jump in speed $\Delta v$ as the incident wave (the direction of propagation being reversed, the jump in speed $\Delta v$ has changed sign if consideration is now given to all the positive speeds in the direction arriving at the seat 5 and no longer in the direction of propagation of the waves). Taking it into account that the first distance is preferably conditional upon the equation: $L_B=f_B(T_B)=f_B(n_B*[\tau/2])$, the reflected wave reaches the seat 5 at exactly the same moment as a new incident wave is produced by the impact due to the closure of the valve element, the movement of the head 4 of the needle 4 also being conditional upon the second distance $L_A$ preferably dependent on a multiple of the half-setpoint period $\tau/2$: $L_A=f_A(T_A)=f_A(n_A*[\tau/2])$. The result of this is that, in the seat 5, the stresses are maintained and the speeds are canceled out. The seat 5 therefore has a movement node. In these conditions, a variation in the pressure in the combustion chamber 15 will induce an amplification of the impacts but without changing their synchronism. The operation of the injector will therefore not be affected by this pressure variation in the combustion chamber 15.

In order to obtain the identity of the jumps in stress $\Delta\sigma$ when the two corresponding waves, the incident and reflected waves, cross, the reflection of the acoustic waves at the first zone of impedance breakage must be as large as possible. This condition of virtually total reflection is a priori satisfied for the nozzle 3 set into the casing 1 associated in its turn with a cylinder head 8, this configuration being able to be similar to an ideal case of a bar of finite diameter (such as a beam) set into an infinite body. Because of the finite size of the actuator 2, the total reflection of the acoustic waves in the zone of junction ZJ between the needle 4 and the actuator 2 is difficult to obtain. In the example illustrated in FIG. 2, in the zone of junction ZJ, the actuator 2 has a linear acoustic impedance $I_{AC-ZJ}$ and the needle 4 has another linear acoustic impedance $I_{A-ZJ}$. A satisfactory compromise in terms of reflection of acoustic waves in the zone of junction ZJ may be obtained if the ratio $I_{AC-ZJ}/I_{A-ZJ}$ is greater than a predetermined value. Preferably, the following relation is verified: $I_{AC-ZJ}/I_{A-ZJ} \geqq 2.5$.

In the light of the details above, it should be understood that, in the general case for the first and second multiplying coefficients such that $n_B \neq n_A$, it is the incident waves and the reflected waves shifted by a few periods $\tau$ which compensate for one another in the seat 5 in order to render it dynamically fixed. It is possible for this compensation not to be total when, for example, the difference between $n_B$ and $n_A$ is greater than a predetermined value and/or a dissipation of the acoustic waves in the nozzle 3 (and, finally, of its linear acoustic impedance) exceeds a certain threshold. That is why the configuration of the injector with $n_B = n_A$ and, in particular, $n_B = n_A = 1$ appears to be a priori more reliable acoustically and remains preferred relative to that in which $n_B \neq n_A$.

It should be understood that the first distance $L_B = f_B(T_B)$ and the second distance $L_A = f_A(T_A)$ respectively with respect to the first "nozzle 3+casing 1" and the second "needle 4+actuator 2" media for propagation of the acoustic waves are defined, preferably with the aid of the respective acoustic times-of-flight $T_B = n_B * [\tau/2]$ and $T_A = n_A * [\tau/2]$, in an acoustic context. The latter is due to the presence of the (ultra sonic) vibrations of the setpoint period $\tau$, initiated by the second portion 22 of the actuator 2, as evoked above. In other words, the first distance $L_B = f_B(T_B)$ and the second distance $L_A = f_A(T_A)$ are between two acoustic limits. Generally, a first acoustic limit used to define both the first distance $L_B$ and the second distance $L_A$ is represented by one end of an assembly in question ("nozzle 3+casing 1" or "needle 4+actuator 2"). In a simplified manner, it is possible to consider that this first acoustic limit is indistinguishable from the zone of contact between the first end 6 of the needle 4 (optionally extended axially by the head 7 (or 7')) and the seat 5 (or 5') of the nozzle 3, as illustrated in FIG. 1 (or 2).

In the example illustrated in FIG. 1 with the needle 4 with the outward-facing head 7, it must be understood that the first acoustic limit used to determine the second distance $L_A$ relative to the second "needle 4+actuator 2" medium for propagation of the acoustic waves is taken half way up the divergent frustoconical outward-facing head 7. Similarly, the first acoustic limit used to determine the first distance $L_B = f_B(T_B)$ relative to the first "nozzle 3+casing 1" medium for propagation of the acoustic waves is taken half way up the corresponding divergent frustoconical seat 5.

In the example illustrated in FIG. 2 with the needle 4 with the inward-facing head 7', it must be understood that the first acoustic limit used to determine the second distance $L_A$ relative to the second "needle 4+actuator 2" medium for propagation of the acoustic waves is taken half way up the convergent frustoconical inward-facing head 7'. Likewise, the first acoustic limit used to determine the first distance $L_B = f_B(T_B)$ relative to the first "nozzle 3+casing 1" medium for propagation of the acoustic waves is taken half way up the corresponding convergent frustoconical seat 5'.

The second acoustic limit specific to each of the two assemblies is represented by the respective first zone of linear acoustic impedance breakage I, as detailed above. For example, the second acoustic limit may correspond to the location where the diameter of the assembly in question varies in a plane perpendicular to the axis AB, for example at the zone of junction ZJ of the needle 4 with the first portion 21 of the actuator 2 or at the location of recessing SX of the nozzle 3 in the casing 1 (FIGS. 1, 2), it being understood that:

- in the zone of junction ZJ, the needle 4 and the actuator 2 are made, for example, by machining in a monobloc part made of material preferably having the same density and the same velocity of sound, and
- in the location of recessing SX, the nozzle 3 and the casing 1 are made, for example, by machining in a monobloc part made of material preferably having the same density and the same velocity of sound.

Specifically, the machining of a monobloc part presents the simplest solution to use during manufacture of said parts on an industrial scale.

Figure 8:
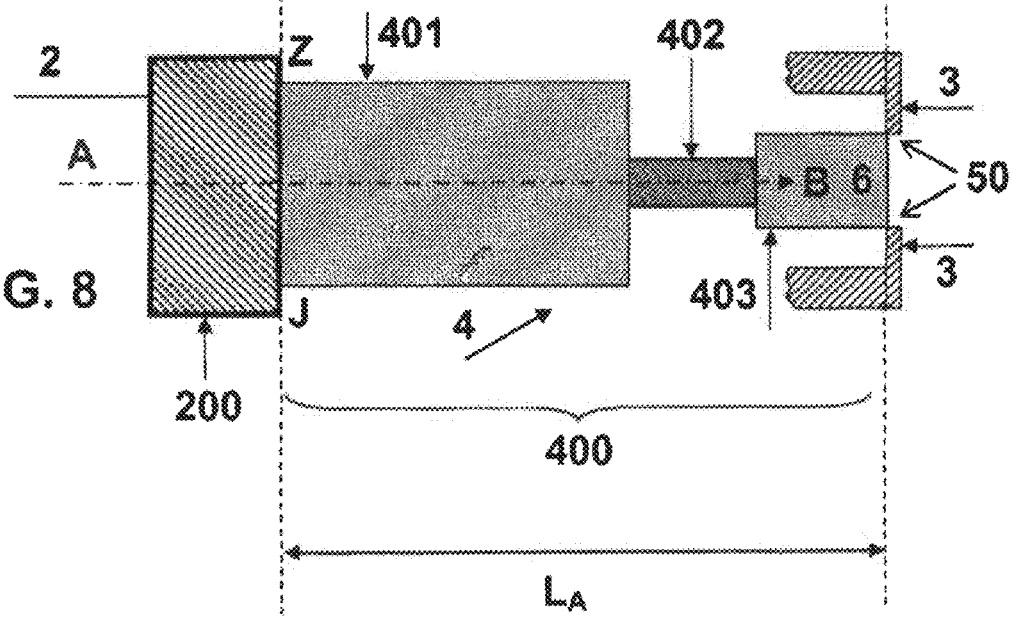
Figure 10:
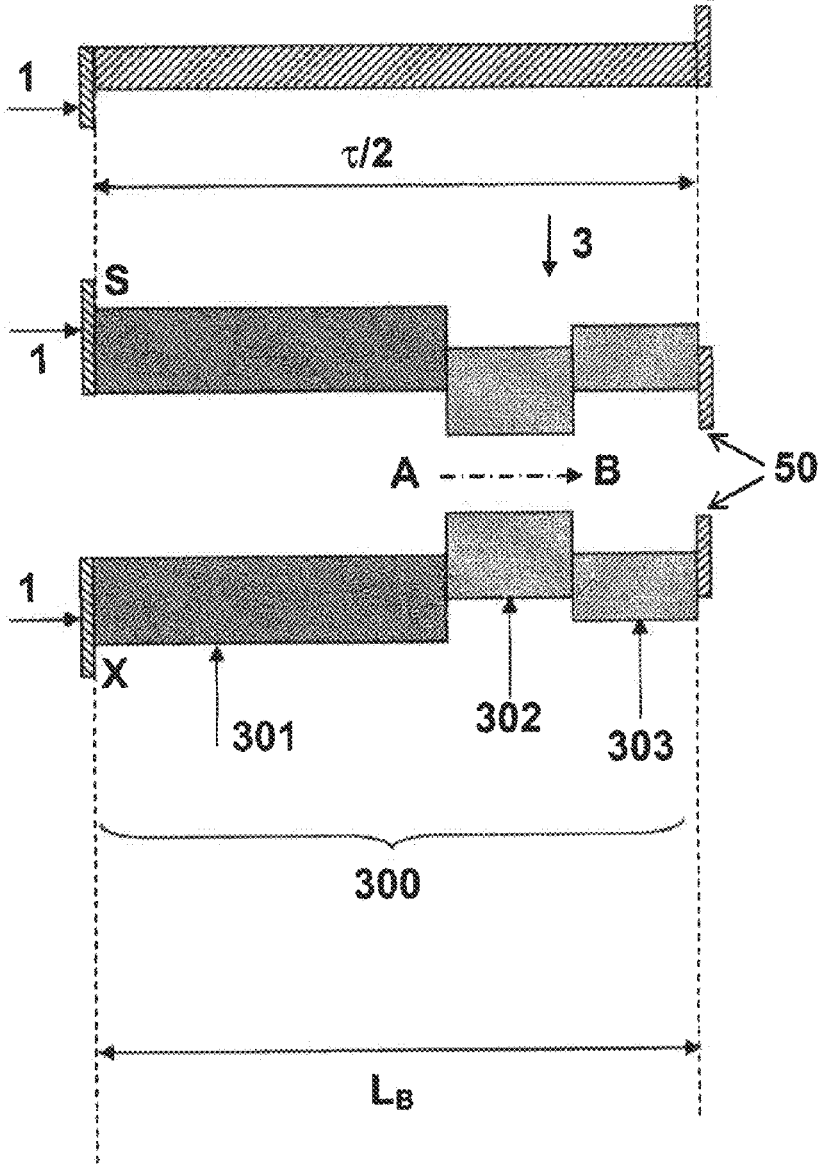

However, in certain cases, the acoustic limits of the bodies may not correspond to the physical limits of the bodies, as shown by two examples below. As illustrated in FIG. 10, within the first medium of acoustic wave propagation, over said first distance $L_B$, there are a plurality of segments 301, 302, 303 that are differentiated from one another by at least two criteria amongst the following three criteria specific to each of the segments 301, 302, 303: (a) geometry of the segment; (b) density $\rho$ of the segment; (c) velocity c of the sound in the segment, the segments 301, 302, 303 being such that their respective linear acoustic impedances—$I_{301} = \Sigma_{301} * \rho_{301} * c_{301}$; $I_{302} = \Sigma_{302} * \rho_{302} * c_{302}$; $I_{303} = \Sigma_{303} * \rho_{303} * c_{303}$—are equal: $I_{301} = I_{302} = I_{303}$. Therefore, irrespective of their respective linear dimensions, no interfering echo is generated in zones of junction between two respective segments: 301/302, 302/303, so that the first distance $L_B$ remains between the seat 50 and the recessing location SX of the nozzle 3 in the casing 1 (FIG. 10). Therefore, it is possible to produce the nozzle 3 in different materials, by combining them so as to give the nozzle 3 locally and/or axially selective physical properties (other than acoustic properties), specific to each of the segments 301, 302, 303 (for example by improving their resistance to impacts, by reducing their mechanical wear and/or their thermal expansion), provided that their acoustic properties along the axis AB represented by the respective linear acoustic impedances $I_{301}/I_{302}$, $I_{303}$ remain the same: $I_{301} = I_{302} = I_{303}$. As illustrated in FIG. 8, within the second medium of acoustic wave propagation, over said second distance $L_A$, there are a plurality of segments 401, 402, 403 that are differentiated from one another by at least two criteria amongst the following three criteria specific to each of the segments 401, 402, 403: (a) geometry of the segment; (b) density $\rho$ of the segment; (c) velocity c of the sound in the segment, the segments 401, 402, 403 being such that their respective linear acoustic impedances—$I_{401} = \Sigma_{401} * \rho_{401} * c_{401}$; $I_{402} = \Sigma_{402} * \rho_{402} * c_{402}$; $I_{403} = \Sigma_{403} * \rho_{403} * c_{403}$—are equal: $I_{401} = I_{402} = I_{403}$. Therefore, irrespective of their respective linear dimensions, no interfering echo is generated in zones of junction between two respective segments: 401/402, 402/403, so that the second distance $L_A$ remains between the seat 50 and the zone of junction ZJ of the needle 4 in the actuator 2 (FIG. 8). Therefore, it is possible to produce the needle 4 in different materials, by combining them so as to give the needle 4 locally and/or axially selective physical properties (other than acoustic properties) specific to each of the segments 401, 402, 403 (for example by improving their resistance to impacts, by reducing their mechanical wear and/or their thermal expansion), provided that their acoustic properties along the axis AB represented by the respective linear acoustic impedances $I_{401}$, $I_{402}$, $I_{403}$ remain the same: $I_{401}=I_{402}=I_{403}$.

As illustrated in FIG. 2, the zone of junction ZJ between the needle 4 and the actuator 2 may be formed on the side of the actuator 2 by at least the first portion 21 of the actuator 2. The first portion 21 preferably has a circular cross section with a predetermined diameter, called diameter $D_{1-1}$ of the first portion 21, measured in a plane perpendicular to the axis AB. The zone of junction ZJ between the needle and the actuator 2 is formed on the side of the needle 4 by at least one axisymmetric section with a predetermined diameter, called diameter $D_4$ of the needle 4, measured in a plane perpendicular to the axis AB. Preferably, the first portion 21 and the cylindrical section of the needle 4 are made of a material having an identical density ρ and velocity c of sound. The diameter $D_{1-1}$ of the first portion 21 of the actuator 2 and the diameter $D_4$ of the needle 4 are linked by the following inequality: $D_{1-1}/D_4 \geqq \sqrt{2.5}$. Advantageously, this ratio of diameters $D_{1-1}/D_4$ corresponds to an acceptable "acoustic recessing" of the needle 4 in the actuator 2. By virtue of this acceptable acoustic recessing, an incident wave leaving the head 7' of the needle 4 and arriving along the needle 4 in the zone of junction ZJ (FIG. 2) is reflected there with a minimum of losses of amplitude and/or of frequency that may disrupt the opening and closing of the valve element with the setpoint period of τ (and, therefore, the control of the movement of the head 7' of the needle 4 evoked above).

In order to make the injector perform still better in terms of acoustics, the length L between the two limits C, D of the block formed by the three portions 21, 22, 23 of the actuator 2 (FIG. 1-2) is such that the time T for propagating the acoustic waves initiated by the vibrations of the second portion 22 of the actuator 2 and traveling over this length L=f(T) satisfies the following equation:

$$T=n*[\tau/2], \quad \text{(E3)}$$

where n is a multiplying coefficient, a non-zero positive integer, called the third multiplying coefficient, for example, $n \neq n_B \neq n_A$. By analogy with the nozzle 3 and the needle 4, the actuator 2 may therefore have a symmetrical acoustic structure such that an echo of an acoustic wave transmitted in a location of the symmetrical block tends to return, after one or more reflections at the limits of the block, to this same location of transmission of the acoustic wave a non-zero positive integer number of periods after it has been transmitted. This acoustic symmetry of the actuator 2 is particularly advantageous when the acoustic recessing of the needle 4 in the actuator 2 is not perfect and the incident wave leaving the head 7' of the needle 4 and arriving along the needle 4 in the zone of junction ZJ (FIG. 2) manages to enter the latter, after a partial reflection on the first limit D of the actuator 2. However, because of the acoustic symmetry of the actuator 2, the echo of this incident wave returning to the first limit 213 a non-zero positive integer number of periods after its transmission, this generates no delay or change of sign of the waves transmitted to the first limit 213 so that the alternating movement back-and-forth of the needle 4 is not disrupted.

By analogy with the equations referenced E1 and E2 above, it should be understood that the equation referenced E3 above must be considered as verified give or take a certain tolerance in order to take account of the manufacturing constraints, for example, at a tolerance of the order of plus or minus 10% of the setpoint period τ, that is to say of the order of plus or minus 20% of the half-setpoint period τ/2. Taking this tolerance into consideration, the equation referenced E3 above may be rewritten as follows:

$$T=n*[\tau/2]\pm 0.2*[\tau/2] \quad \text{(E3')}$$

It should be noted that, in practice, the length L=f(T) expressed as acoustic time-of-flight T and measured on corresponding parts manufactured on an industrial scale may have slight variations relative to the reference values calculated with the aid of the equation E3 above. These slight variations may be due to an effect of attached weights. The latter may correspond, for example, to appendages or to gripping or assembly machinings. Said tolerance makes it possible to take account of said attached weight effect so as to correct the expression in acoustic time-of-flight of the length L=f(T) with the aid of the equation E3' above.

For the same reasons as those evoked above with reference to $n_B$ and $n_A$, it is preferable for $n=n_B=n_A$ and, in particular, for $n=n_B=n_A=1$.

Figure 11:
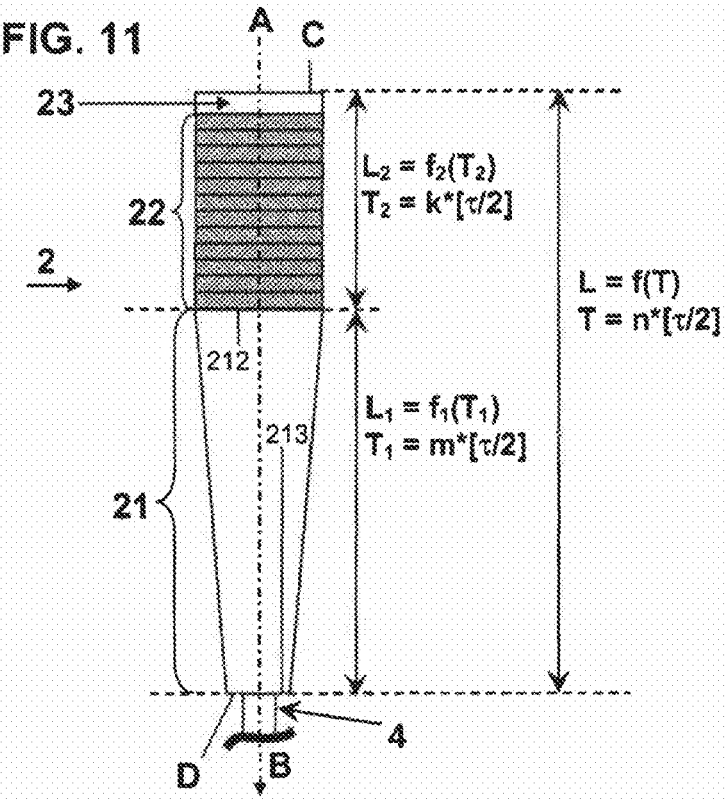
FIG. 11 represents schematically the actuator in a simplified side view in longitudinal section.

As illustrated in FIG. 11, the first portion 21 of the actuator 2 may have axially a first limit 213 indistinguishable from the limit D at which the block is connected to the needle 4 and a second opposite limit 212, squeezed against the electroactive material 221 of the second portion 22 of the actuator 2. Preferably, the first length $L_1$ measured between said first limit 213 and second limit 212 is such that the time $T_1$ for propagating the acoustic waves initiated by the vibrations of the second portion 22 of the actuator 2 and traveling along this first length $L_1=f_1(T_1)$ satisfies the following equation:

$$T_1=m*[\tau/2], \quad \text{(E4)}$$

where m is a multiplying coefficient, a non-zero positive integer, for example $m \neq n \neq n_B n_A$. This configuration is adapted, for example, to the case in which, in addition to the imperfect acoustic recessing of the needle 4 in the actuator 2 already mentioned above, the actuator 2 has a new zone of linear acoustic impedance breakage at the second limit 212. By virtue of the acoustic symmetry of the first portion 21 of the actuator 2, no delay or change of sign of the waves transmitted to the first limit 213 is generated despite their interfering echoes generated by the new zone of linear acoustic impedance breakage at the second limit 212, so that the alternating axial movements back-and-forth of the needle 4 are not disrupted.

By analogy with the equations referenced E1 to E3 above, it should be understood that the equation referenced E4 above should be considered as verified give or take a certain tolerance to take account of the manufacturing constraints, for example, at a tolerance of the order of plus or minus 10% of the setpoint period τ, that is to say of the order of plus or minus 20% of the half-setpoint period τ/2. Taking this tolerance into consideration, the equation referenced E4 above can be rewritten as follows:

$$T_1=m*[\tau/2]\pm 0.2*[\tau/2] \quad \text{(E4')}$$

It should be noted that, in practice, the first length $L_1=f_1(T_1)$, expressed as acoustic time-of-flight $T_1$ and measured on corresponding parts manufactured on an industrial scale, can have slight variations relative to the reference values calculated with the aid of the equation E4 above. These slight variations may be due to an effect of attached weights. The latter may correspond, for example, to appendages or to machinings for gripping or assembly. Said tolerance makes it possible to take account of said effect of attached weights so as to correct the expression in acoustic time-of-flight of the first length $L_1=f_1(T_1)$ with the aid of the equations E4' above.

For the same reasons as those evoked above with reference to $n_B$ and $n_A$, it is preferable for $m=n_B=n_A$ and, in particular, for $m=n_B=n_A=1$.

Preferably, the second length $L_2$ measured between this second limit 212 and the limit C of the block that is axially opposite to the needle 4 is such that the time $T_2$ for propagating the acoustic waves initiated by the vibrations of the second portion 22 of the actuator 2 and traveling along this second length $L_2=f_2(T_2)$ satisfies the following equation:

$$T_2=k*[\tau/2], \quad \text{(E5)}$$

where k is a multiplying coefficient, a non-zero positive integer, for example, $k\neq m\neq n\neq n_B\neq n_A$. This acoustically symmetrical configuration is adapted, for example, to the case in which the new zone of linear acoustic impedance breakage at the second limit 212 has only a partial linear acoustic impedance breakage, so that the acoustic waves traveling axially up the first portion 21 of the actuator manage to enter, after their partial reflections on the second limit 212 of the actuator 2, its second portion 22 without disrupting an alternating axial movement of the second limit 212 and/or that of the first limit 213 and/or, finally, that of the needle 4.

By analogy with the equations referenced E1 to E4 above, it should be understood that the equation referenced E5 above should be considered as verified give or take a certain tolerance to take account of the manufacturing constraints, for example, at a tolerance of the order of plus or minus 10% of the setpoint period $\tau$, that is to say of the order of plus or minus 20% of the half-setpoint period $\tau/2$. Taking this tolerance into consideration, the equation referenced E5 above can be rewritten as follows:

$$T_2=k*[\tau/2]\pm 0.2*[\tau/2] \quad \text{(E5')}$$

It should be noted that, in practice, the second length $L_2=f_2(T_2)$, expressed as acoustic time-of-flight $T_2$ and measured on corresponding parts manufactured on an industrial scale, can have slight variations relative to the reference values calculated with the aid of the equation E5 above. These slight variations may be due to an effect of attached weights. The latter may correspond, for example, to appendages or to machinings for gripping or assembly. Said tolerance makes it possible to take account of said effect of attached weights so as to correct the expression in acoustic time-of-flight of the second length $L_2=f_2(T_2)$ with the aid of the equations E5' above.

For the same reasons as those evoked above with reference to $n_B$ and $n_A$, it is preferable for $k=n_B=n_A$ and, in particular, for $k=n_B=n_A=1$.

To make it easier to assemble on an industrial scale, over at least 90% of the second length $L_2$, the actuator has a linear acoustic impedance variation that is less than or equal to 5%. Thanks to this arrangement, it becomes possible, for example, to stack the ceramic piezoelectric shims forming the second portion 22 of the actuator 2 and having a slight variation in their sizes, for example, their axial sizes, without creating an inadmissible difference in acoustic terms that can disrupt the ordered operation of the injector.

Preferably, the first portion 21 of the actuator 2 is designed to transmit the vibrations of the electroactive material 221 to the needle 4 by amplifying them so that the movements of the needle 4 at the valve element are greater than the integral of the deformations of the electroactive material 221. Any section perpendicular to the axis AB of the first portion 21 has, on said axis AB, movements produced by the acoustic waves traveling over the first portion 21 from its second limit 212 to its first limit 213. Preferably, the first portion 21 of the actuator 2 has, on said axis AB, a linear acoustic impedance variation $I_{21}$ such that the axial movements of a section perpendicular to the axis AB and situated at the first limit 213 are greater than those of any other section of the first portion 21, the linear acoustic impedance $I_{21}$ of the first portion 21 being defined by the following equation: $I_{21}=\Sigma_{21}*\rho_{21}*c_{21}$ where $\Sigma_{21}$ is a surface of a section of the first portion 21 perpendicular to the axis AB, $\rho_{21}$ is a density in the first portion 21, $c_{21}$ is a velocity of the sound in the first portion 21. The selective deformations of the second portion 22 of the actuator 2 induced by those of the electroactive material 221 are then amplified so as to produce the greatest possible movement at the first limit 213 of the actuator 2 and, consequently, at the first end 6 of the needle 4, this first limit 213 thereby becoming a location called a "belly" where the vibrations (in particular the movements) are amplified and at a maximum.

Figure 12:
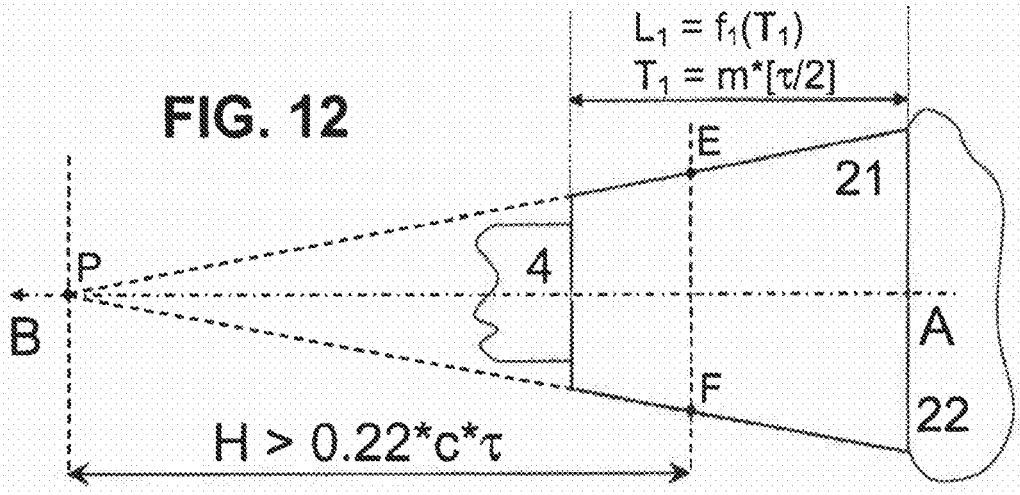
FIG. 12 represents schematically a first portion of the actuator connected to the needle in a partial, simplified side view.

Preferably, the first portion 21 of the actuator 2 comprises at least one frustoconical segment which narrows, on the axis AB, toward the needle 4 (FIGS. 11, 12). The frustoconical segment with changing cross section in a plane perpendicular to the axis AB substantially linear or exponential on the axis AB makes it possible to obtain an amplification of the selective deformations of the second portion 22 of the actuator 2 induced by those of the electroactive material 221. Compared with the first portion 21, for example cylindrical in shape (FIG. 13), the portion comprising the frustoconical segment (FIGS. 11-12) makes it possible to obtain the same movement at the first limit D with fewer ceramic piezoelectric shims stacked axially. In addition to a time saving during assembly of the injector on an industrial scale, this arrangement makes the actuator 2 more reliable both in terms of assembly quality and in terms of service life, the ceramic piezoelectric shims—fragile by nature-intrinsically presenting a risk of breaking and/or cracking. Preferably, the distance H, on the axis AB, between any section EF of the frustoconical segment perpendicular to the axis AB and an imaginary point P of the frustoconical segment (FIG. 12) satisfies the following inequality: $H>0.22*c*\tau$. Thanks to this arrangement, a dispersion of the acoustic waves observed in the frustoconical segment amplifying the movement remains acceptable, so as not to disturb the ordered operation of the injector.

Figures 13, 14, 15:
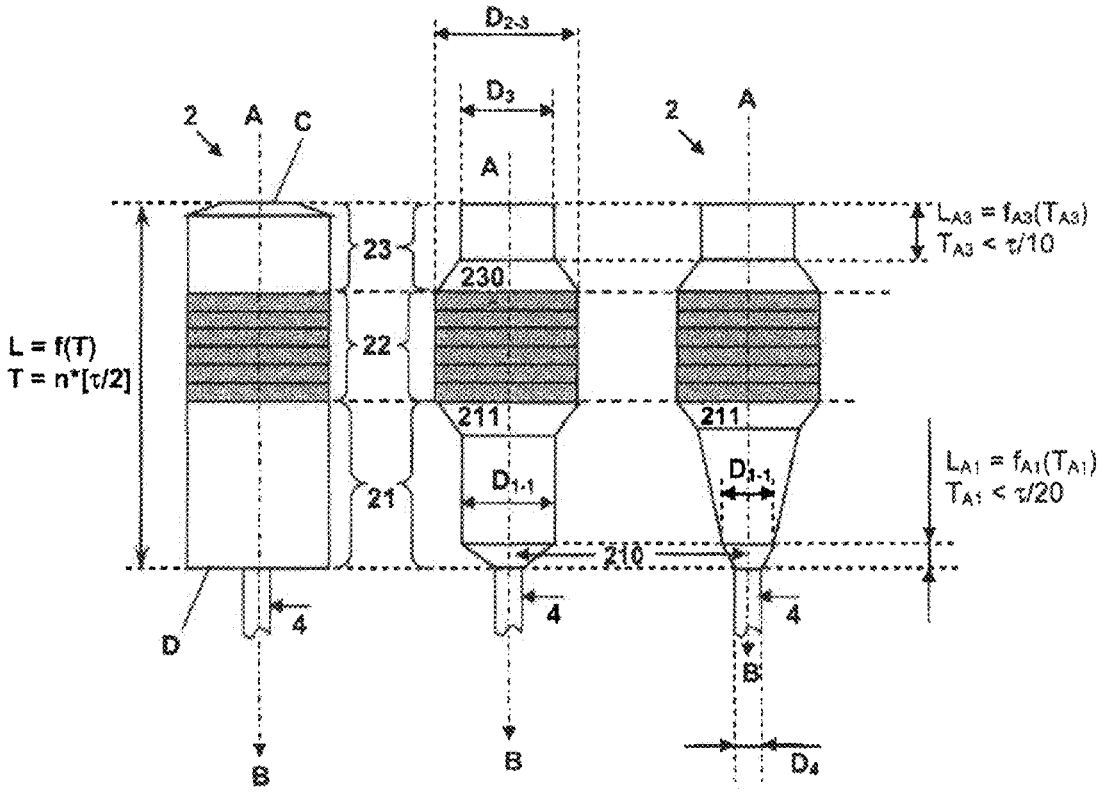
FIGS. 13 to 15 represent schematically in simplified side views in longitudinal section respectively three different diagrams of the actuator.
Figure 16:
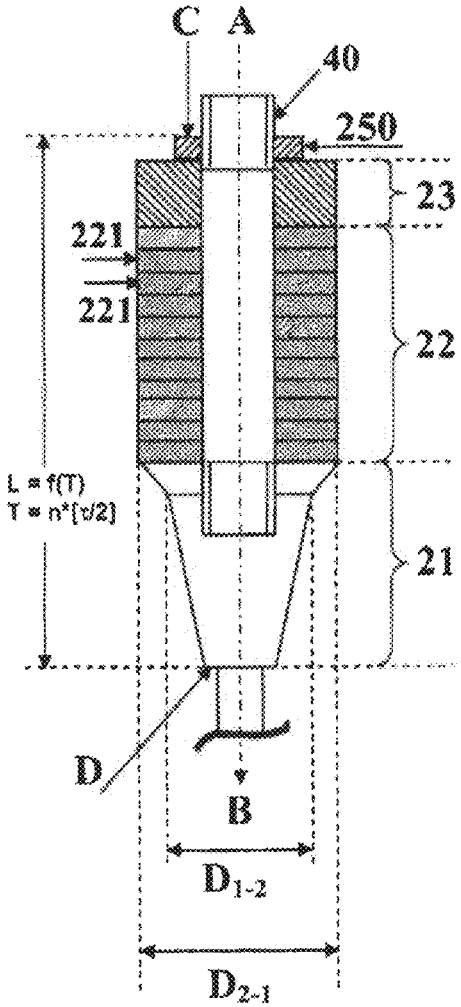
FIG. 16 represents schematically in a simplified side view in longitudinal section the actuator comprising a central rod.

As explained in detail above, the actuator 2 is made in several portions 21, 22, 23 that may be differentiated from one another by their geometry and/or by their density $\rho$ and/or by the velocity c of the sound specific to each of them (FIG. 13-17). That is why, in order to produce the injector with the actuator 2 having, for example, the predetermined linear acoustic impedance I that is preferably constant, for example, over its length L between the two limits C, D, and/or over its first length $L_1$, and/or over its second length $L_2$, said portions 21, 22, 23 of the actuator 2 may have respectively cross sections of different surface areas in planes perpendicular to the axis AB, in order to compensate for possible variations in the linear acoustic impedance I by those of the surface $\Sigma$ of the corresponding cross sections perpendicular to the axis AB. A first example is shown in FIGS. 14-15 and relates to the third portion 23 and the second portion 22 of the actuator 2 having respectively cross sections $D_3$ and $D_{2-3}$ with different surface areas in planes perpendicular to the axis AB. A second example is shown in FIG. 16 and relates to the first portion 21 and the second portion 22 of the actuator 2 having respectively cross sections $D_{1-2}$ and $D_{2-1}$ with different surface areas in planes perpendicular to the axis AB. A third example is shown in FIGS. 14-15 and relates to the first portion 21 of the actuator 2 and the needle 4 have respectively cross sections $D_{1-1}$ and $D_4$ with different surface areas in planes perpendicular to the axis AB. In order to be able to ensure the most even distribution possible of the stresses between the portions with different cross sections, segments for connection between the three portions 21, 22, 23 of the actuator 2 and/or between the first portion 21 and the needle 4 may be provided. Preferably, the third portion 23 may comprise a segment 230 for connection with the second portion 22 having axially a length $L_{A3}$ such that the time $T_{A3}$ for propagating the acoustic waves initiated by the vibrations of the second portion 22 of the actuator 2 and traveling along this length $L_{A3}=f_{A3}(T_{A3})$ satisfies the following inequality: $T_{A3}<\tau/10$ (FIGS. 14-15). Thanks to this arrangement, the most even distribution possible of the stresses between the third portion 23 and the second portion 22 is obtained over limited lengths $L_{A3}=f_{A3}(T_{A3})$.

Figure 17:
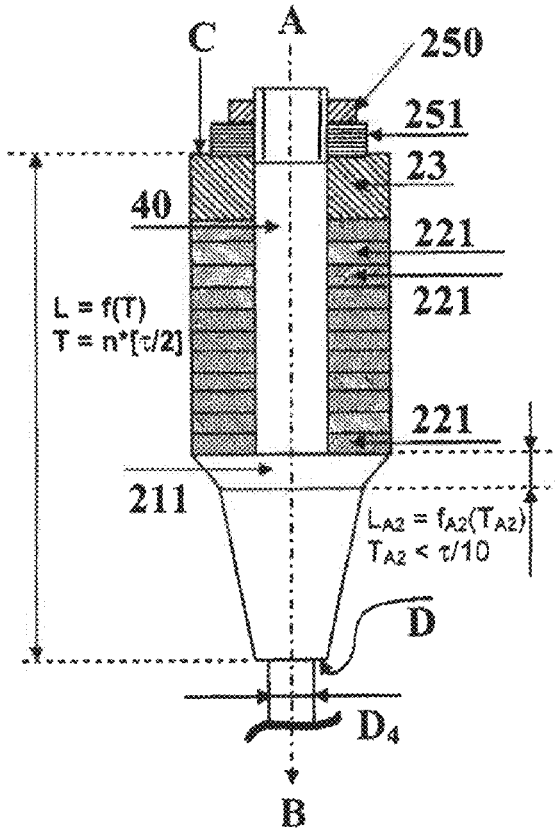
FIG. 17 represents schematically in a simplified side view in longitudinal section the actuator comprising the central rod, a prestress means and an elastic means.

Preferably, the first portion 21 comprises a segment 211 for connection with the second portion 22 having axially a length $L_{A2}$ such that the time $T_{A2}$ for propagating the acoustic waves initiated by the vibrations of the second portion 22 of the actuator 2 and traveling along this length $L_{A2}=f_{A2}(T_{A2})$ satisfies the following inequality: $T_{A2}<\tau/10$ (FIG. 17). Thanks to this arrangement, the most even distribution possible of the stresses between the first portion 21 and the second portion 22 is obtained over limited lengths $L_{A2}=f_{A2}(T_{A2})$.

Preferably, the first portion 21 comprises a segment 210 for connection with the needle 4 having axially a length $L_{A1}$ such that the time $T_{A1}$ for propagating the acoustic waves initiated by the vibrations of the second portion 22 of the actuator 2 and traveling along this length $L_{A1}=f_{A1}(T_{A1})$ satisfies the following inequality: $T_{A1}<\tau/20$. Thanks to this arrangement, the concentrations of the stresses are reduced between the first portion 21 and the needle 4. This result is obtained over very reduced lengths $L_{A2}=f_{A2}(T_{A2})$ in order to ensure an acceptable recessing on the acoustic matter discussed above of the needle 4 in the actuator 2.

The connection segments 210, 211, 230 may have a frustoconical shape, with for example a half-angle at the vertex of 45°. This frustoconical geometry is the easiest to produce in terms of machining. However, this frustoconical geometry is not limiting. It is also possible to envisage the connection segments 210, 211, 230 being parts of revolution limited by two planes perpendicular to a preferred axis, for example their axis of symmetry, and a surface generated by the rotation of a curve defined in a plane containing said axis. This curve may be of sigmoid and/or exponential type.

To make it easier to assemble the actuator 2 on an industrial scale, the first portion 21 of the actuator 2 can be extended, on the axis AB, away from the needle 4, by a central rod 40 which may be fitted (FIG. 16) or not (FIG. 17). In this configuration, the second portion 22 and the third portion 23 of the actuator 2 are threaded onto the central rod 40. The central rod 40 may have a thread to make it easier to squeeze the three portions 21, 22, 23 of the actuator 2 together with the aid, for example, of a prestress means 250 preferably comprising a threaded nut. In a less preferred embodiment (not shown), the third portion 23 and the prestress means 250 may be indistinguishable. In this case, the third portion 23 may have a thread suitable for being screwed directly onto the central rod 40 thus providing the prestress of the electroactive material 221 of the second portion 22 of the actuator 2. In another less preferred embodiment (not shown), the third portion 23, the prestress means 250 and the second portion 22 may be indistinguishable.

Preferably, the central rod 40 has a thermal expansion (in particular a coefficient of thermal expansion) that is substantially identical to that of the electroactive material 221 of the second portion 22 of the actuator 2 (FIG. 16). The electroactive material 221, ceramic for example, having a coefficient of thermal expansion that is extremely small, the rod 40 must also have a coefficient of thermal expansion that is extremely small, for example equal to approximately $10^{-6}$/° C. For example, for the ceramic electroactive material 221, the central rod 40 may be made of an iron and nickel alloy with carbon and chrome, for example, an alloy of the "invar" type. Thanks to this arrangement, the prestress of the electroactive material 221 tends to remain constant irrespective of the variations in temperature of the injector. The same expansion of the two materials (electroactive material 221 and that of the central rod 40) ensures a thermal compensation for the expansions due to the variations in temperature of the injector. Assembly of the actuator 2 becomes faster because it requires no other means for compensating for said expansions of the two materials. Preferably, the central rod 40 has a thermal expansion that is substantially equal to the total of the thermal expansions of the electroactive material 221 (ceramic), of the third portion 23 and of the first portion 21 that induces no stress variations in the electroactive material 221, which is for example ceramic, that are greater than 5 MPa for 100° C. of variation in temperature of the injector.

Alternatively, the central rod 40 may have a thermal expansion (in particular a coefficient of thermal expansion) that differs from that of the electroactive material 221 of the second portion 22 of the actuator 2 (FIG. 17) and, in particular, that differs from the total of the thermal expansions of the electroactive material 221 (ceramic), of the third portion 23 and of the first portion 21. For example, the central rod 40 may have the coefficient of thermal expansion that is greater than that of the electroactive material 221 of the second portion 22 of the actuator 2. In this case, the prestress means 250 connected to the central rod 40 and suitable for squeezing the three portions 21, 22, of the actuator 2 together is connected, via an elastic means 251 (for example, at least one rubbery seal, at least one elastic shim or a spring), to the end of the block of the actuator 2 opposite to the needle 4. The elastic means 251 makes it possible to provide a virtually constant prestress of the electroactive material 221 irrespective of the elongations of the central rod 40 due to the thermal expansions. Thanks to this arrangement, it is possible to continue the assembly of the actuator 2 on an industrial scale, for example, when the invar rods are out of stock. Therefore, this embodiment helps to make the manufacture of the injector more reliable.

Finally, according to the configuration of FIG. 16, it is also possible to ensure that the difference between the coefficients of expansion of the electroactive material 221 (ceramic) and of the materials of the third portion 23, of the first portion 21 and of the central rod 40 may be chosen so that the differential expansions of these parts do not induce, in the operating temperature range of the injector, a variation in the prestress of the electroactive material 221 that is more than 10% of the nominal stress value (induced by the prestress means 250).

It should be understood that, through its geometry, its density, its velocity of sound, the central rod 40 makes a negligible contribution acoustically. For example, when the central rod 40 is solid, its diameter, measured in a plane perpendicular to the axis AB, may be negligible (unlike what is shown schematically without scale in FIGS. 16-17) relative to the diameter $D_{2-1}$ of the second portion 22, and even to the diameter $D_4$ of the needle 4. To summarize, the presence of the central rod 40 does not significantly influence the length L=f(T) of the block comprising the three portions 21, 22, 23 of the actuator 2, expressed in acoustic time-of-flight T with the aid of the equations (E3) and (E3') above.

When the central rod 40 has the thermal expansion substantially equal to the total of the thermal expansions of the electroactive material 221 (ceramic), of the third portion 23 and of the first portion 21 (in particular, when the central rod 40 has the thermal expansion substantially equal to that of the electroactive material 221 (ceramic)), it should be understood that, acoustically, the length L=f(T) described by the equation (E3) above (capable, in turn, of being specified with the aid of the equation (E3')) still remains between the two opposite limits (transverse faces) C, D of the block, as illustrated in FIG. 16, it being understood that the definition already discussed above of the first limit referenced D in FIG. 16 (the transverse face oriented toward the needle 4 of the first portion 21 of the actuator 2) remains unchanged, the other limit referenced C in FIG. 16 corresponds to that of the prestress means 250 (its transverse face) opposite to the needle 4 and not to that of the third portion 23 (its transverse face) opposite to the needle 4.

When the central rod 40 has the thermal expansion that is substantially different from the total of the thermal expansions of the electroactive material 221 (ceramic), of the third portion 23 and of the first portion 21 (in particular, when the central rod 40 has the thermal expansion that is different from that of the electroactive material 221 (ceramic)), it should be understood that, acoustically, the definitions already discussed above of the two limits C and D (FIG. 17) of the block comprising the three portions 21, 22, 23 of the actuator 2 remain unchanged (in particular, the limit C of the block corresponds to that of the third portion 23 opposite to the needle 4) so that the length L=f(T) of the block described by the equation (E3) above (being able, in turn, to be specified with the aid of the equation (E3')) still remains between these two limits C, D (FIG. 17). Specifically, the elastic means 251 has a low linear impedance and the acoustic waves are reflected to the limit C forming an interface between the third portion 23 and the elastic means 251 so that no acoustic wave originating axially from the third portion 23 enters the prestress means 250 through the elastic means 251. Since the presence of the central rod 40 is negligible acoustically as specified above, the linear acoustic impedance breakage between the third portion 23 and the elastic means 251 may be likened to a total breakage, so there is no longer any continuity of the acoustic medium between the third portion 23 and the prestress means 250, as indicated in FIG. 17.

The invention claimed is:

1. A fluid injection device having a main injection axis and comprising:

a nozzle comprising, on said axis, an injection orifice and a seat and being, at an opposite end, connected to a casing;

a needle having, on said axis, a first end defining a valve element, in a zone of contact with the seat and being, at an opposite end, connected to an actuator mounted so as to be able to move axially in the casing to vibrate the needle, providing between the first end of the needle and the seat of the nozzle a relative movement capable of alternately opening and closing the valve element, the actuator comprising, on the axis, a first portion, a second portion and a third portion suitable for being traversed by acoustic waves initiated by vibrations of the second portion, the first portion and third portion being placed axially on either side of the second portion, which comprises an electroactive material, the three portions being squeezed together in order to form a block having axially two opposite limits, including a first limit and a second limit of the block, the first portion being connected to the needle at a location of the first limit of the block; and excitation means for vibrating the second portion of the actuator with a setpoint period $\tau$, wherein a length between the two limits of the block is such that a time for propagating the acoustic waves initiated by the vibrations of the second portion of the actuator and traveling along the length satisfies following equation: $T=n*[\tau/2]$, plus or minus a tolerance and where n is a multiplying coefficient, a non-zero positive integer.

2. The injection device as claimed in claim 1, wherein the first portion of the actuator has axially a first limit indistinguishable from the limit at which the block is connected to the needle and a second opposite limit, squeezed against the electroactive material of the second portion of the actuator, and a first length between said first limit and second limit of the first portion is such that the time for propagating the acoustic waves initiated by the vibrations of the second portion of the actuator and traveling along the first length satisfies following equation: $T_1=m*[\tau/2]$, plus or minus a tolerance and where m is a multiplying coefficient, a non-zero positive integer.

3. The injection device as claimed in claim 1, wherein the first portion of the actuator has axially a first limit indistinguishable from the limit at which the block is connected to the needle and a second opposite limit, squeezed against the electroactive material of the second portion of the actuator, and a second length between the second limit of the first portion and the second limit of the block that is axially opposite to the needle is such that the time for propagating the acoustic waves initiated by the vibrations of the second portion of the actuator and traveling along the second length satisfies following equation: $T_2=k*[\tau/2]$, plus or minus a tolerance and where k is a multiplying coefficient, a non-zero positive integer.

4. The injection device as claimed in claim 3, wherein over at least 90% of the second length, the actuator has a linear acoustic impedance variation that is less than or equal to 5%.

5. The injection device as claimed in claim 1, wherein the third portion and the second portion of the actuator have respectively cross sections with different surface areas in planes perpendicular to the axis, and the third portion comprises a segment for connection with the second portion having axially a length such that a time $T_{A3}$ for propagating the acoustic waves initiated by the vibrations of the second portion of the actuator and traveling along the length of the third portion satisfies following inequality: $T_{A3}<\tau/10$.

6. The injection device as claimed in claim 1, wherein any section perpendicular to the axis of the first portion of the actuator has, on said axis, movements produced by the acoustic waves traveling over the first portion from the second limit to the first limit of the first portion, and the first portion of the actuator has, on said axis, a linear acoustic impedance variation such that the axial movements of a section perpendicular to the axis and situated at the first limit of the first portion are greater than those of any other section of the first portion, a linear acoustic impedance of the first portion being defined by following equation: $I_{21}=\Sigma_{21}*\rho_{21}*c_{21}$ where $\Sigma_{21}$ is a surface of a section of the first portion perpendicular to the axis, $\rho_{21}$ is a density in the first portion, $c_{21}$ is a velocity of the sound in the first portion.

7. The injection device as claimed in claim 1, wherein the first portion comprises at least one frustoconical segment which narrows, on the axis, toward the needle, and a distance H, on the axis, between any section of the frustoconical segment perpendicular to the axis and an imaginary point of the frustoconical segment satisfies following inequality: $H>0.22*c*\tau$, where c is the velocity of sound in the frustoconical segment.

8. The injection device as claimed in claim 1, wherein the first portion and the second portion of the actuator have respectively cross sections with different surface areas in planes perpendicular to the axis, and the first portion comprises a segment for connection with the second portion having axially a length such that a time $T_{A2}$ for propagating the acoustic waves initiated by the vibrations of the second portion of the actuator and traveling along the length of the first portion satisfies following inequality: $T_{A2}<\tau/10$.

9. The injection device as claimed in claim 1, wherein the first portion of the actuator and the needle have respectively cross sections with different surface areas in planes perpendicular to the axis, and wherein the first portion comprises a segment for connection with the needle having axially a length such that a time $T_{A1}$ for propagating the acoustic waves initiated by the vibrations of the second portion of the actuator and traveling along the length of the first portion satisfies following inequality: $T_{A1}<\tau/20$.

10. The injection device as claimed in claim 1, wherein the first portion of the actuator is extended, on the axis, away from the needle, by a central rod and the second portion and the third portion of the actuator are threaded onto the central rod.

11. The injection device as claimed in claim 10, wherein the central rod has a thermal expansion that is identical to that of the electroactive material of the second portion of the actuator.

12. The injection device as claimed in claim 10, wherein the central rod has a thermal expansion that differs from that of the electroactive material of the second portion of the actuator, and a prestress means connected to the central rod is suitable for squeezing the three portions of the actuator together, and is connected, via an elastic means, to the end of the block of the actuator opposite to the needle.

13. The injection device as claimed in claim 1, wherein the nozzle with the casing and the needle with the actuator form respectively a first and a second media for propagating acoustic waves, each medium having a linear acoustic impedance defined by following equation: $I=\Sigma*\rho*c$ where $\Sigma$ is a surface with a cross section of the medium perpendicular to the axis, $\rho$ is a density of the medium, c is a velocity of the sound in the medium, at least one zone of linear acoustic impedance breakage existing at a distance from the zone of contact of the seat with the first end along the nozzle or the casing, and at least one other zone of linear acoustic impedance breakage existing at a distance from the zone of contact of the first end with the seat along the needle or the actuator, and said zone and other zone of linear acoustic impedance breakage each being first in the order from said zone of contact between the first end of the needle and the seat, in a direction of propagation of the acoustic waves that is oriented respectively toward the casing and the actuator, wherein the first distance, between the zone of contact between the seat and the first end and the first zone of linear acoustic impedance breakage along the nozzle or the casing, is such that a time $T_B$ for propagation of the acoustic waves initiated by the second portion of the actuator and traveling along this first distance satisfies following equation: $T_B=n_B*[\tau/2]$, plus or minus a tolerance and where $n_B$ is a multiplying coefficient, a non-zero positive integer, and the second distance, between the zone of contact between the first end and the seat and the first zone of linear acoustic impedance breakage along the needle or the actuator, is such that a time $T_A$ for propagation of the acoustic waves initiated by the second portion of the actuator and traveling along this second distance satisfies following equation: $T_A=n_A*[\tau/2]$, plus or minus a tolerance and where $n_A$ is a multiplying coefficient, a non-zero positive integer.

14. The fluid injection device as claimed in claim 13, wherein, within the first medium of acoustic wave propagation, over said first distance, there are a plurality of segments that are differentiated from one another by at least two criteria amongst the following three criteria specific to each of the segments: (a) geometry of the segment; (b) density $\rho$ of the segment; (c) velocity c of the sound in the segment, the segments being such that their respective linear acoustic impedances ($I_{301}$), ($I_{302}$), ($I_{303}$) are equal: $I_{301}=I_{302}=I_{303}$.

15. The fluid injection device as claimed in claim 13, wherein, within the second medium of acoustic wave propagation, over said second distance, there are a plurality of segments that are differentiated from one another by at least two criteria amongst the following three criteria specific to each of the segments: (a) geometry of the segment; (b) density $\rho$ of the segment; (c) velocity c of the sound in the segment, the segments, being such that their respective linear acoustic impedances ($I_{401}$), ($I_{402}$), ($I_{403}$) are equal: $I_{401}=I_{402}=I_{403}$.

16. The fluid injection device as claimed in claim 13, wherein the needle and the actuator are connected together by a zone of junction which transmits the acoustic waves, and, in the zone of junction, the actuator has a linear acoustic impedance $I_{AC-ZJ}$ and the needle has a linear acoustic impedance $I_{A-ZJ}$, and the following relation is verified: $I_{AC-ZJ}/I_{A-ZJ}\geqq 2.5$.

17. The fluid injection device as claimed in claim 16, wherein the first portion of the actuator comprises at least one circular cross section with a predetermined diameter $D_{1-1}$ of the first portion, measured in a plane perpendicular to the axis, the zone of junction between the needle and the actuator is formed on the side of the actuator by said circular cross section, the zone of junction between the needle and the actuator is formed on the side of the needle by at least one axisymmetric section with a predetermined diameter $D_4$ of the needle, measured in a plane perpendicular to the axis, and wherein the diameter $D_{1-1}$ of the first portion of the actuator and the diameter $D_4$ of the needle are linked by the following inequality: $D_{1-1}/D_4\geqq\sqrt{2.5}$.

18. An internal combustion engine system comprising the fluid injection device as claimed in claim 1.

19. The fluid injection device as claimed in claim 1, wherein the electroactive material is magnetostrictive and the excitation means for vibrating includes a coil coupled to or surrounding the actuator, and the coil is configured to create a magnetic induction in the electroactive material of the actuator.

20. The fluid injection device as claimed in claim 1, wherein the electroactive material is piezoelectric and the excitation means for vibrating is configured to apply a potential difference across the electroactive material of the actuator to create an electric field in the electroactive material.

* * * * *